US006731210B2

(12) United States Patent
Swanson et al.

(10) Patent No.: US 6,731,210 B2
(45) Date of Patent: May 4, 2004

(54) SYSTEM AND METHOD FOR DETECTING, LOCALIZING, OR CLASSIFYING A DISTURBANCE USING A WAVEGUIDE SENSOR SYSTEM

(75) Inventors: David C. Swanson, State College, PA (US); Nicholas C. Nicholas, State College, PA (US); David Rigsby, Fairfax, VA (US)

(73) Assignee: The Penn State Research Foundation, University Park, PA (US)

( * ) Notice: Subject to any disclaimer, the term of this patent is extended or adjusted under 35 U.S.C. 154(b) by 4 days.

(21) Appl. No.: 10/137,615

(22) Filed: May 2, 2002

(65) Prior Publication Data

US 2003/0020610 A1 Jan. 30, 2003

Related U.S. Application Data

(60) Provisional application No. 60/288,028, filed on May 2, 2001.

(51) Int. Cl.[7] ..... G08B 13/00

(52) U.S. Cl. ..... 340/566; 340/561; 340/668

(58) Field of Search ..... 340/566, 561, 340/668, 552, 541

(56) References Cited

U.S. PATENT DOCUMENTS

| | | | |
|---|---|---|---|
| 3,836,899 | A | 9/1974 | Duvall et al. |
| 4,097,025 | A | 6/1978 | Dettmann et al. |
| 4,144,530 | A | 3/1979 | Redfern |
| 4,209,776 | A | 6/1980 | Frederick |
| 4,365,239 | A | 12/1982 | Mongeon |
| 4,367,459 | A | 1/1983 | Amir et al. |
| 4,500,873 | A | 2/1985 | Porat et al. |
| 4,683,356 | A | 7/1987 | Stoler |
| 4,818,972 | A | 4/1989 | Mainiero et al. |
| 4,829,286 | A | 5/1989 | Zvi |
| 4,829,287 | A | 5/1989 | Kerr et al. |
| 4,879,544 | A | 11/1989 | Maki et al. |
| 4,906,975 | A | 3/1990 | Casella et al. |
| 4,916,433 | A | 4/1990 | ver Loren van Themaat |
| 4,978,943 | A | 12/1990 | Mainiero et al. |
| 5,239,459 | A | 8/1993 | Hunt et al. |
| 5,371,488 | A | 12/1994 | Couch et al. |
| 5,578,990 | A | 11/1996 | Sanford, Jr. et al. |
| 5,787,369 | A | 7/1998 | Knaak |
| 6,216,985 | B1 | 4/2001 | Stephens |

*Primary Examiner*—Thomas J Mullen, Jr.
(74) *Attorney, Agent, or Firm*—McKee, Voorhees & Sease, P.L.C.

(57) ABSTRACT

A vibration detection and classification system and associated methods are disclosed. The system includes a waveguide in operative contact with a boundary, such as a security fence. At least one sensor for sensing vibrations such as acoustic waves is operatively connected to the waveguide, the waveguide extending the range of the sensor. At least one control circuit is operatively connected to the one or more sensors and is adapted for detecting and classifying vibrations. The method includes securing an area protected by a boundary by mechanically transmitting a vibration from a portion of the boundary to a waveguide, transmitting the vibration along the waveguide to a sensor, sensing the vibration at the sensor, determining at least one characteristic associated with the vibration, and using the at least one characteristic associated with the vibration to determine if the vibration is indicative of an intrusion.

46 Claims, 6 Drawing Sheets

SYSTEM AND METHOD FOR DETECTING, LOCALIZING, OR CLASSIFYING A DISTURBANCE USING A WAVEGUIDE SENSOR SYSTEM

CROSS-REFERENCE TO RELATED APPLICATIONS

This application claims priority to the U.S. provisional patent application Ser. No. 60/288,028 entitled "Security Fence Acoustic Waveguide Sensor System for Detecting, Localizing and Classifying Intrusion" filed on May 2, 2001 and herein incorporated by reference in its entirety.

BACKGROUND OF THE INVENTION

This invention relates to a system and methods for monitoring of boundaries. More specifically, but without limitation, this invention relates to a security system that transmits vibrations along a waveguide and then senses the vibrations to detect, localize, and/or classify the vibration.

The prior art discloses a number of different means to detect intrusions or other disturbances in a fence or other boundary. One common method is to use taut wire systems. One example of a taut wire system is disclosed in U.S. Pat. No. 4,829,287 to Kerr et al. In such a taut wire system, sensors such as pressure sensors or strain gauges are used to sense changes in the tension of the wire. In this and other systems, because tension is being sensed, a number of sensors are required along the fence to ensure that an intrusion does not go undetected. If there is too great of distance between sensors, then added tension due to an intrusion may go unnoticed.

Prior art detection systems using geophones also work in a similar manner, wherein the number of geophones needed to detect a signal directly increases with the size of the area that is being secured. The present invention uses a waveguide to transmit vibrations thus does not require a large number of sensors. This reduces cost and/or increases the distance that can be covered.

Another type of system involves leaky coaxial cables. One example of a leaky coaxial cable system is disclosed in U.S. Pat. No. 4,879,544 to Maki et al. In such a system, two cables are run parallel to one another, one acting as a transmitter, the other acting as a receiver. When the radio frequency signal leaks from the transmitter cable to the receiver cable, a field is created between the two cables. The changes in the field are monitored to determine if an intrusion has occurred. If the cable is cut, then this type of system fails to work and requires repair.

Another type of system uses fibre optic cables. The fibre optic cables are attached to a fence. When the cable is cut or otherwise broken, an alarm occurs. Such a system is not useful for determining every type of intrusion, and once the cable is cut it will need to be replaced. The present invention provides for simplified repair or replacement which results in less cost and less down time.

Thus, it is a primary object of the present invention to provide a method and system for detecting, localizing, or classifying a disturbance that improves upon the state of the art.

Another object of the present invention is to provide for a method and system for detecting, localizing, or classifying a disturbance that effectively extends the range of an acoustic or vibration sensor thus reducing the number of sensors required.

A further object of the present invention is to provide a method and system for detecting, localizing, or classifying a disturbance that is easily repairable and minimizes down time.

Yet another object of the present invention is to provide a method and system for a security system that can be implemented either above ground or underground.

Another object of the present invention is to provide for a method and system for detecting, localizing, or classifying a disturbance that is compatible with irregularly shaped fences or other boundaries.

Another object of the present invention is to provide for a method and system for detecting, localizing, or classifying a disturbance that is flexible in implementation and application such that both large areas or small areas can be detected.

Another object of the present invention is to provide for a method and system for detecting, localizing, or classifying a disturbance that is reliable.

Another object of the present invention is to provide for a method and system for detecting, localizing, or classifying a disturbance that is low in cost.

These and other objects, features, or advantages of the present invention will become apparent from the specification and claims.

SUMMARY OF THE INVENTION

The present invention is directed towards a system and method of using a waveguide sensor system for applications that include, but are not limited to detecting, localizing, and classifying a disruption along a boundary. A particular application, described throughout, but to which the invention is not limited, is the use of the present invention in a security system. In a security system, the disruption that occurs along a boundary may be caused by an intrusion. The boundary can be associated with a security fence, but need not be.

According to one aspect of the present invention, a vibration detection and classification system includes a waveguide in operative contact with a boundary, at least one sensor for sensing vibrations, and a control circuit operatively connected to the at least one sensor. The control circuit can be adapted for detecting and classifying the vibrations to determine if the boundary has been crossed by an intruder.

Another aspect of the present invention relates to the case where the boundary is a fence. A vibration coupler is used to connect the fence with the waveguide. The vibration can be an arc-shaped band of metal and the waveguide can be a tensioned wire. The waveguide allows vibrational waves to be received and/or transmitted by the control circuit. Where the vibrational waves are received by more than one control circuit, the location of the disturbance can be determined through time estimation or other means. Thus, the present invention can provide for localization.

Another aspect of the present invention provides for a method of securing an area protected by a boundary. The method includes mechanically transmitting a vibration from a portion of the boundary to a waveguide, transmitting the vibration along the waveguide to a sensor, sensing the vibration at the sensor, determining at least one characteristic associated with the vibration, and using the at least one characteristic associated with the vibration to determine if the vibration is indicative of an intrusion. If an intrusion is detected, then the present invention provides for an alarm or an alert, the deployment of weapons systems, or other measures to be taken.

The present invention contemplates numerous applications and varying levels of complexities of security systems that can be implemented according to the present invention.

For example, one application of the present invention is suitable to secure fences along national borders, military installations, airports, or other large areas. In such an application, more complex sensing systems and processing can be used for enhanced localization and classification of a disturbance. Additional alarm or alert systems can also be used in such a system. The present invention is also suitable for smaller and/or less sophisticated installations, including installations where localization of a disturbance is not required.

DETAILED DESCRIPTION OF PREFERRED EMBODIMENT

The present invention is now described in the context of one or more preferred embodiments. The present invention, however, is not to be merely limited to what is described herein, but to what is claimed. The present invention is directed towards a system and method of using a waveguide sensor system for applications that include, but are not limited to detecting, localizing, and/or classifying a disruption along a boundary. A particular application, described throughout, but to which the invention is not limited, is the use of the present invention in a security fence for detection, classification and/or localization of intrusions. The present invention, however, contemplates that the system and methods of the present invention can be used to for monitoring purposes.

Figure 1:
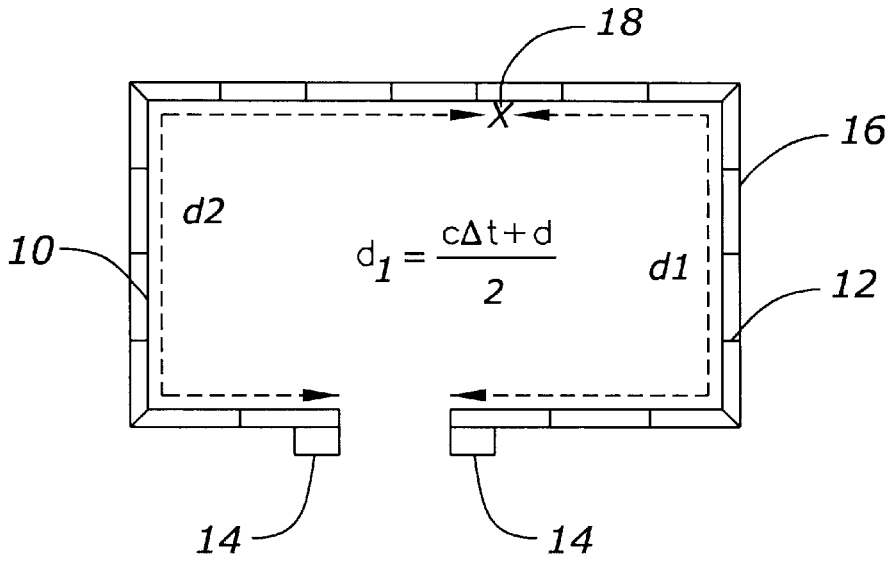
FIG. 1 is a plan view of a fenced area equipped with one embodiment of the present invention.

In FIG. 1, a waveguide 10 is stretched around the perimeter of a new or existing fence 16. The waveguide 10 is secured to the fence by a plurality of vibration couplers 12. The waveguide 10 is installed such that it is kept taut between the vibration couplers 12. When a disturbance 18 occurs along the fence 16, the vibrational wave created by the disturbance 18 travels in both directions along the waveguide 10. These vibrational waves are intercepted by a plurality of transceivers 14. The transceivers can include a control circuit that can include a processor adapted for time delay estimation. By comparing the difference in time between the interception of the vibrational waves by the transceivers 14, the present invention can determine the location of the disturbance through time delay estimation. Thus, in this manner, the present invention provides for the detection and localization of a disruption.

Figure 2:
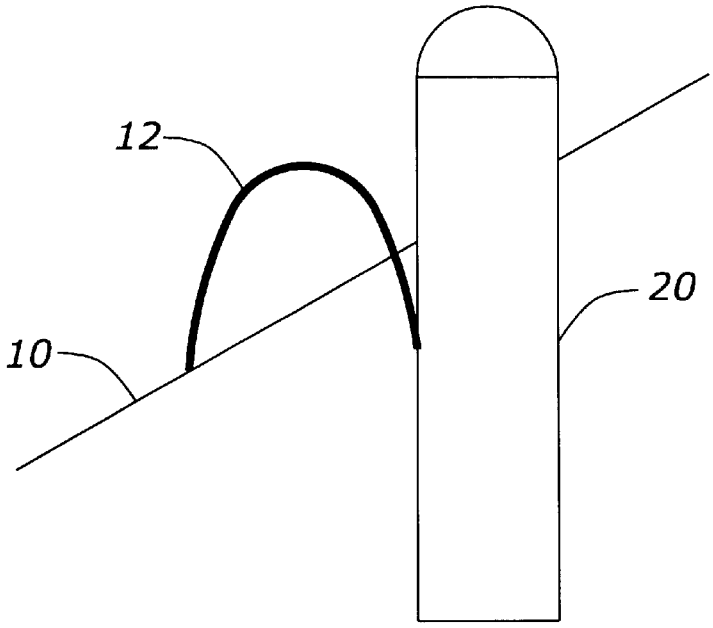
FIG. 2 is a side elevation view of a fence post including a vibration coupler and waveguide according to one embodiment of the present invention.

In FIG. 2, the waveguide 10 is secured to a plurality of fence posts 20 by a plurality of vibration couplers 12. The waveguide 10 may be comprised of any metallic or nonmetallic wire or cord-like material of the requisite strength and tension. One can choose practical tensions and wire thicknesses appropriate for the particular sensor fence installation. For safety and maintenance reasons, it is preferred to keep wire tensions between 50 to 200 pounds, however, the present invention is not to be limited to any particular wire tension. Tension is best maintained using a simple system of weights and pulleys. Alternatively, the waveguide 10 may be comprised of a hollow pipe filled with air, a known gas, or a liquid. Such a waveguide is particularly useful when the waveguide is located underground. The vibration coupler 12 may be formed of any material of the requisite strength and flexibility. In the preferred embodiment, the vibration coupler 12 comprises a stiff arc-shaped band of metal. The flatter the arc, the stiffer the vibration coupler 12 becomes in the horizontal direction relative to the vertical direction. The thickness of the metal in the vibration coupler 12 also impacts the overall stiffness due to the moment and shear force created by the bending of the vibration coupler 12. It is desirable to have a high degree of stiffness in the horizontal direction and a low degree of stiffness in the vertical direction. With the vibration coupler 12 hanging down supporting the weight of the waveguide 10, horizontal motion of the top of the fence 16 translates into a downward and horizontal motion of the waveguide 10. Since the vibration couplers 12 are stiff horizontally, the horizontal motion of the waveguide 10 follows that of the fence 16. The vertical motion, however, propagates freely along the waveguide 10 since the vertical stiffness is low. The amount of vertical motion associated with a disturbance can be used to classify the disturbance as an intrusion or other condition or event.

Figure 3:
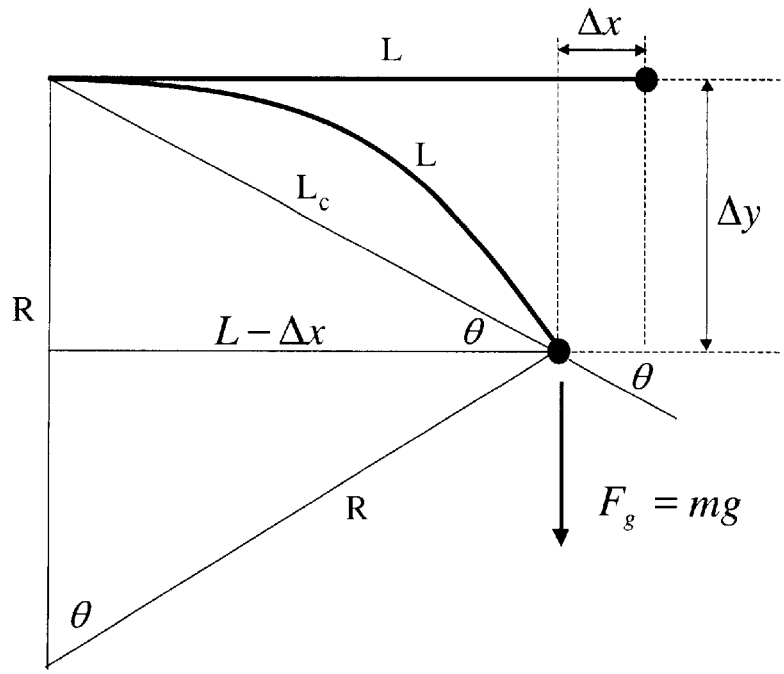
FIGS. 3–6 are diagrams relating to the design of a vibration coupler according to one embodiment of the present invention.

The vibration couplers 12 are spaced along the fence 16 to support the waveguide 10 where the mass of the vibration coupler 12 plus the mass of the section of waveguide 10 per vibration coupler 12 is accelerated downward due to gravity as shown in FIG. 3. The stiffness of the vibration coupler 12 in the vertical direction is found by dividing the force due to gravity by the vertical deflection $k_y=mg/\Delta y$. The mass and vertical stiffness will also form a natural frequency of resonance given in equation (1).

$$f_y = \frac{1}{2\pi}\sqrt{\frac{k_y}{m}} = \frac{1}{2\pi}\sqrt{\frac{g}{\Delta y}} \tag{1}$$

Below this resonance the impedance of the vibration coupler 12 is stiffness dominated such that vibrations of the waveguide 10 will be "clamped" to the fence 16. It is desirable to have the vertical resonance as low as possible to permit a wide bandwidth of vibrations to propagate in the waveguide 10.

The stiffness of the vibration coupler 12 in the horizontal direction is derived as follows. The bending of the vibration coupler 12 approximates an arc of a circle of radius R and angle θ where θ=L/R. The chord of this arc $L_c=2R\sin(\theta/2)$. Equation (2) solves for Δx.

$$\Delta x = L\left\{1-\sqrt{\left(\frac{2\sin\left(\frac{\theta}{2}\right)}{\theta}\right)-\left(\frac{\Delta y}{L}\right)^2}\right\} \tag{2}$$

For angles θ<45° equation (2) can be approximated by $$\Delta x \approx \frac{\Delta y^2}{2L}.$$

The expression in equation (2) is true for a stiff material where the dimension L does not change much as a result of the forces. Use of solid materials such as hardened stainless steel is desirable over a coiled spring in order to keep the horizontal stiffness high.

Figure 4:
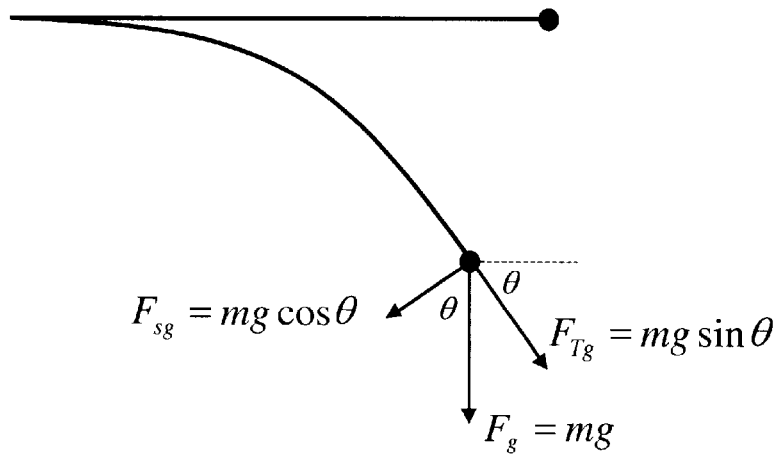
Figure 5:
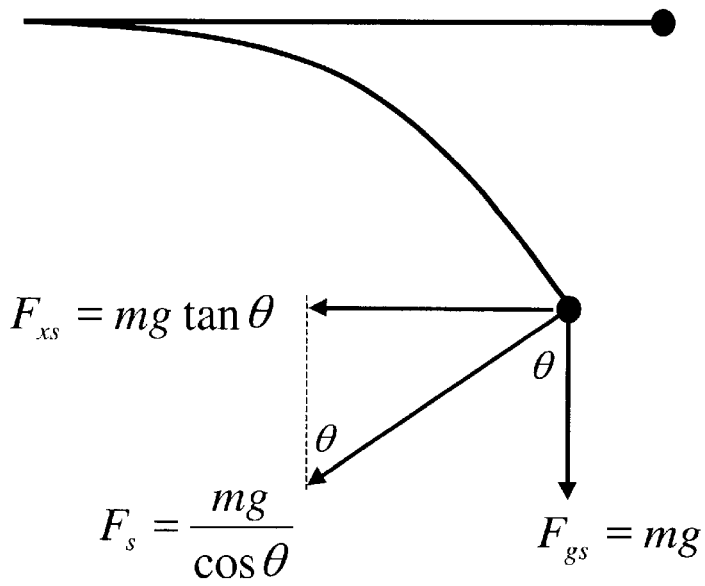

That the force required along the horizontal direction to deflect the vibration coupler 12 is exactly the same as a force due to gravity along the vertical direction follows from the examination of vector diagrams. FIG. 4 shows how the force due to gravity $F_g$ is resolved into components in shear ($F_{sg}$) and tension ($F_{Tg}$). FIG. 5 shows an applied force $F_s$, normal to the end of the vibration coupler 12 and in the same direction as the restoring shear force, and the corresponding forces in the vertical and horizontal directions. The restoring shear force of the vibration coupler 12 is well known and given in equation (3)

$$F_s = \frac{YSt^2/12}{R^2} \tag{3}$$

where Y is Young's modulus, S is the cross section area, t is the thickness, and R is the radius of curvature of the vibration coupler 12. This force increases with the square of the thickness.

Figure 6:
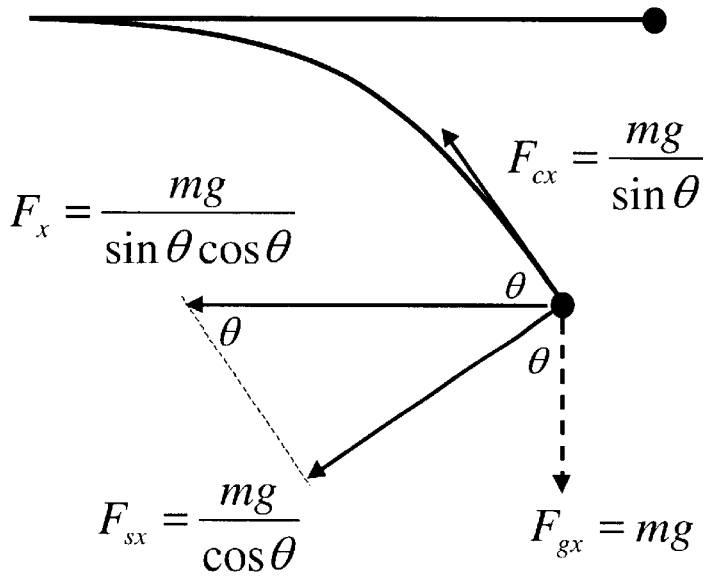

To complete the analysis of the vibration coupler 12 as two independent springs (one vertical and one horizontal), it is necessary to find the equivalent horizontal force that will result in the same deflection as the gravity force. Dividing this force by the corresponding displacement in the horizontal direction will yield the effective horizontal spring stiffness. FIG. 6 shows the applied force required along the horizontal direction to create the same deflection as the force of gravity. For small θ, most of the applied force in FIG. 6 ends up as a compression force in the vibration coupler 12 which make the effective spring stiffness very high. Equation (4) gives the effective horizontal stiffness of the vibration coupler 12.

$$k_x = \frac{2\ \mathrm{mg}}{\Delta x \sin 2\theta} \tag{4}$$

The horizontal resonance is given in equation (5).

$$f_x = \frac{1}{2\pi}\sqrt{\frac{2\ \mathrm{g}}{\Delta x \sin 2\theta}} = f_y 2\sqrt{\frac{L}{\Delta y \sin 2\theta}} \tag{5}$$

Below the horizontal resonance, the waveguide 10 will be dynamically "clamped" to the fence 16 and thus capture the fence vibrations. Above $f_x$, the impedance of the waveguide mass effectively isolates it from the fence vibration. Therefore, it is desirable that this resonance be high so that the waveguide 10 will detect a wide bandwidth of low frequency fence vibrations. For frequencies above $f_y$, the vertical vibrations are effectively isolated from clamping to the ground via the fence posts 20. Thus, the vertical polarized waves will remain propagating in the waveguide 10 for long distances. For a given L and Δy, the lowest $f_x$ occurs when the angle θ equals 45°. An angle of zero will not allow any vertical vibrations. Therefore a compromise of 22.5° is preferred.

The mechanical impedance of the waveguide 10 is equal to $Z_s = \delta c_s$ where $$c_s = \sqrt{\frac{T}{\delta}},$$

T being the wire tension and δ is the wire mass per unit length. This real impedance acts like a damping effect on the vibration coupler 12 resonances, so that a high tension will actually broaden the bandwidth but reduce the waveguide 10 response.

The acoustic waves created by the a disturbance travel through the vibration couplers 12 and down the waveguide 10. The acoustic waves are intercepted by the transceivers 14. The acoustic waves received by the transceivers 14 are converted into electronic signals and are synchronized against an internal or external clock. The time synchronization may be accomplished internally by direct digital communication between the transceivers 14. Alternatively, time synchronization may be conducted by comparing the internal clocks of the transceivers 14 against an external time base such as a Global Positioning System (GPS) clock. By comparing the interception time of the acoustic waves, the wave speed c in the waveguide 10 is used to convert the time difference of the interception of the acoustic waves into the distance to the disturbance as shown in FIG. 1. It is well known that the wave speed c in the waveguide 10 is $c=\sqrt{T/\delta}$, where T is the wire tension and δ is the wire mass per unit length.

Figure 8:
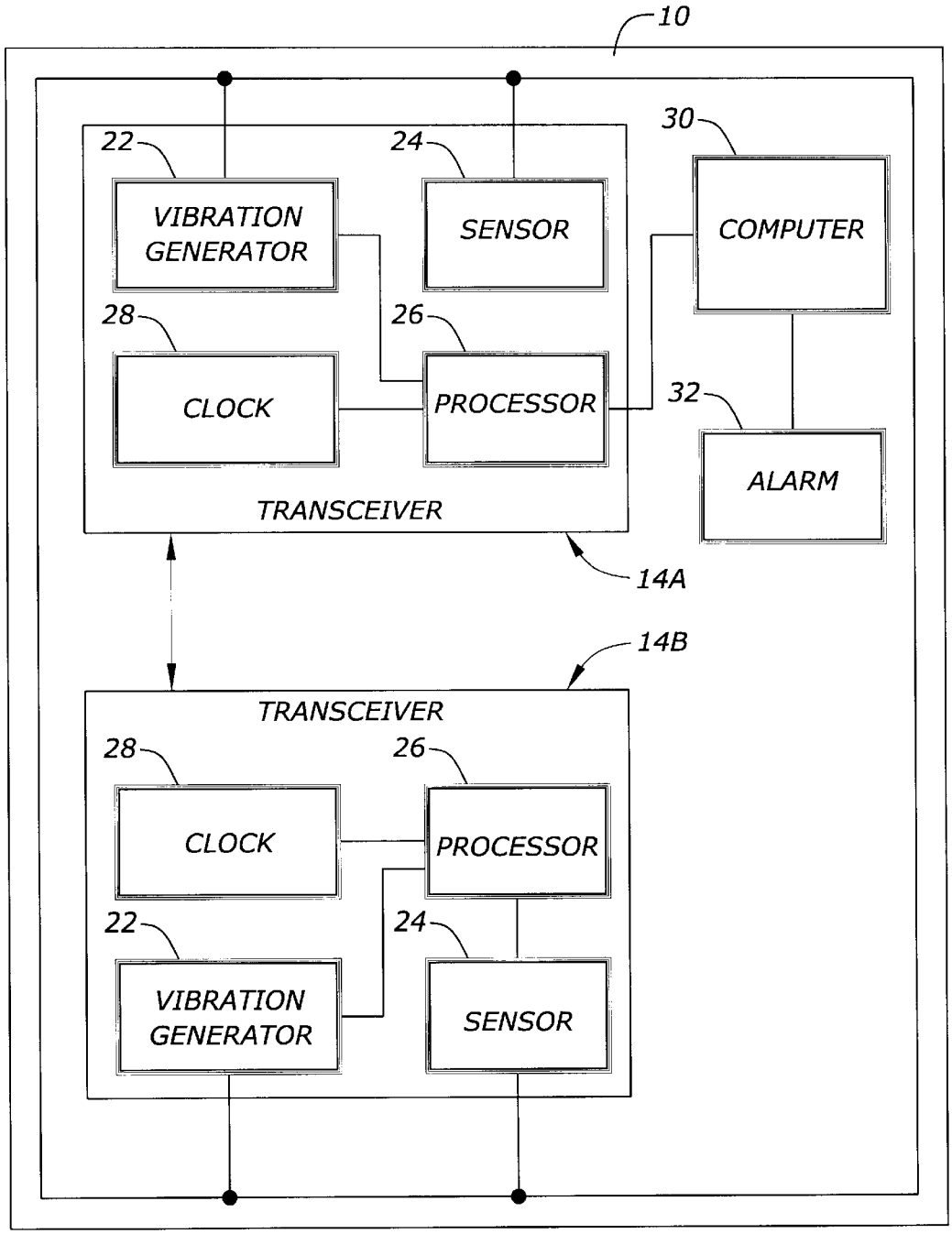
FIG. 8 is a block diagram showing another embodiment of the present invention using transceivers.

In FIG. 8, a waveguide 10 such as tensioned wire is shown. The wave guide-10 is operatively connected to transceivers 14A and 14B. Each transceiver 14 includes a vibration generator or transmitter 22 and a sensor 24 operatively connected to the waveguide 10. The vibration generator 22 can be used for initialization or synchronization purposes. For example, each transceiver 14 also includes a processor 26 that is operatively connected to a clock 28. The clock 28 preferably relies upon the same external time base as any matching transceivers to improve the accuracy of time estimations. For example, each of the clocks 28 can rely upon a time from a GPS signal for synchronization purposes. A computer 30 is optionally connected to one or more of the transceivers 14 to provide for additional processing if desirable and/or additional monitoring or control functions. For example, the computer 30 can also be operatively connected to an alarm 32. The alarm 32 can be of any number of kinds. The alarm can be used to alert intruders that their presence has been detected, or to alert a security force. The alarm can activate lights, or cameras, deploy weapons, or perform other functions as may be appropriate in a particular application or implementation.

Following time synchronization, the signal is passed through an adaptive filter of a control circuit. Wave speed measurement, fence condition monitoring, and intrusion detection, localization, and classification all can be done simultaneously using well-known adaptive noise cancellation techniques. Since the transmitted waveform for wave speed measurement is known by both transceivers, it can be used to model the transfer function between the transmitting and receiving transceivers 14. This transfer function represents the vibration frequency response of the fence 16 and will change when an intruder climbs on or in any way stresses or contacts the fence 16 mechanically. Therefore, an abrupt change in the transfer function indicates an intrusion, damage, or a maintenance problem with the fence 16. Slow changes in the fence response likely indicate environmental changes or normal wear of the fence 16. Using an adaptive filter to model the fence frequency response, the error signal output represents the residual fence vibrations with the known vibration transmission removed. Thus, the error signal of the adaptive filter can be used to detect, localize, and classify intrusion disturbances.

The filtered signal is then analyzed and classified or otherwise further processed. Classification of disturbances is done using well-known statistical, neural network, and/or fuzzy logic techniques to identify and reduce false alarms due to environmental background noise. If the control circuit classifies the signal as a disturbance, the control circuit can alert or activate an external security system.

Because of the vibration generator or transmitter 22, pseudo-random sequences of vibrations can be transmitted along the waveguide 16 from one transceiver 14 to the other. This is useful as it allows for precise re-generation of a transmitted waveguide vibrations for modeling of the fence response and wave speed where the receivers are synchronized to a common clock source. This modeling is useful in deriving acoustic/vibrational signature classifications of intrusion activity and normal environmental activity in the fence. The transceiver is also useful for other applications as well. For example, transmitted waves can be used to measure frequency response of the fence, as a means of measuring wave speed in the waveguide, assessing fence condition, and to detect "quiet" intruders who come in contact with the fence.

Figure 7:
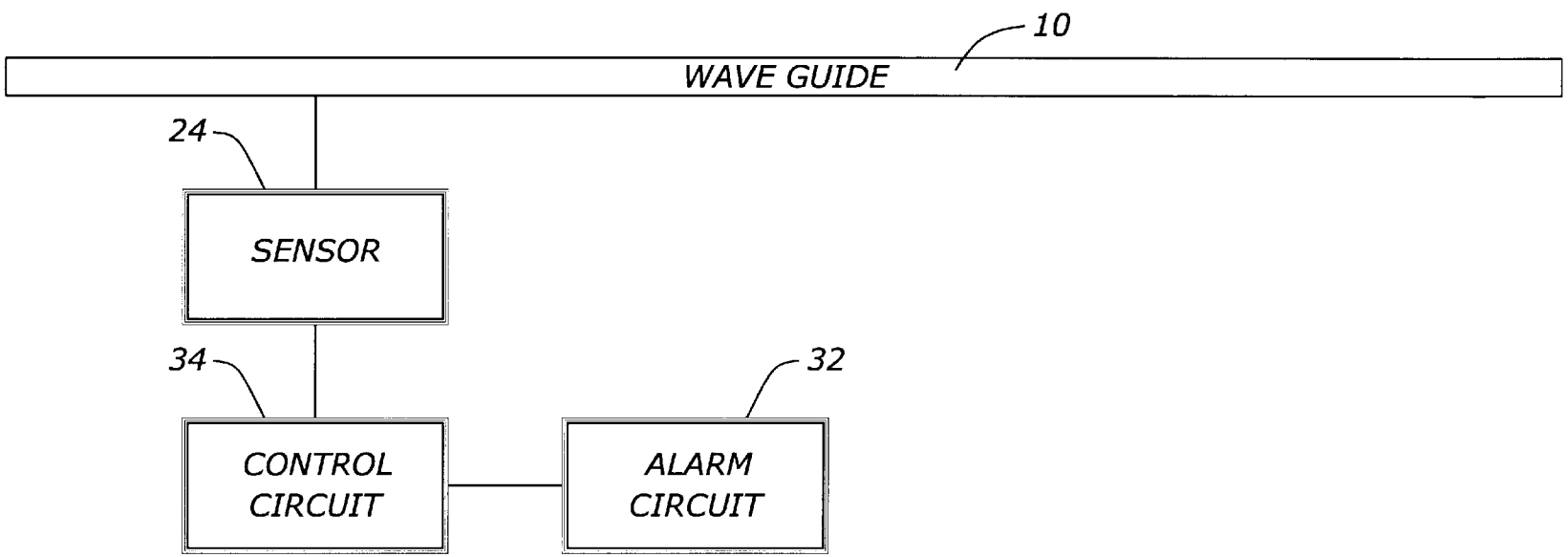
FIG. 7 is a block diagram showing one embodiment of the present invention where only a single sensor is required.

One embodiment of the present invention is directed towards simple and low cost intrusion detection. One such example is shown in FIG. 7 where a sensor 24 is operatively connected to the waveguide 16. A control circuit 34 is operatively connected to the sensor 24. An alarm circuit 32 is operatively connected to the control circuit 34. There are a significant number of "attractive nuisances" such as swimming pools that can benefit from a simple embodiment of FIG. 7 designed for very low cost intrusion detection. The system uses one sensor on a properly designed tensioned wire/clip system and a detection circuit. In one embodiment of the detection circuit, the detection circuit processes two averaged rms signals from the vibration: a long-term average and a short term average. The long term average estimates the "background noise" for the environment and can have a time constant that is selectable by the user. One range of such a time constant is between 5 and 15 minutes, however the present invention contemplates that other ranges and other time constants can be used. The short-term rms average has a user selectable time average of approximately 0.1 to 10 seconds. This signal represents an intrusion. Finally the user selects a threshold as a multiplier times the background noise to trigger the intrusion if the short-term rms averaged signal exceeds this threshold. This is known as a constant false alarm rate detector and is inexpensively developed in a simple analog circuit. The system automatically resets itself after the intrusion stops, or after a delayed period where there is dependent upon the specific applicaiton and implementation used. One duration that can be used is one hour.

The present invention contemplates that trigger response can activate a relay or relays for lights, audible alarms, or call security using a silent alarm if desired. This is ideal for small fence perimeters where localization is not important, but low cost and reliability is important. The swimming pool application is an obvious improvement over water wave detectors that only trigger after someone has entered the pool. Another application is for home security where residents would prefer to use a safe room or leave the house before the intruder actually breaks into the house. The sensor fence offers more time and safety to deal with an intrusion at their property perimeter rather than their dwelling.

This embodiment is designed for small to medium sized perimeters of a few thousand feet or less where it is desired to have detection and localization of one or more simultaneous intrusions. Of course, the present invention contemplates that this embodiment may be used in other installations or applications. Computer automation permits the localization to activate or pan a camera to the intrusion area, turn on lights, and permit security forces to make a rapid closure on the intruders. In this type of fence, the waveguide can enclose the area to be secured.

If the fence has a lot of corners requiring the wire to be supported by pulleys, there will be significant reflections of the waves by the mass of each pulley. This complicates attempts at time delay estimation as a means of localization. Note that there are waves travelling in the wire at speeds proportional to the square root of tension divided by mass per unit length, and very high speeds from the compressional wave speed in the wire material. The presence of pulleys to manage the tensioned wire complicate time delay estimation, but they also attenuate the waves transmitted past the pulleys to the sensors. This makes each area of the fence to produce a unique ratio of loudness of the intrusion disturbance for the two wire vibration sensors at either end of the wire. The localization algorithm can use either time delay estimation, loudness ratio, or a combination of the two depending on the circumstances of the fence installation.

For the loudness ratio, one mapping technique has proved to be quite useful, although the present invention contemplates that other techniques can be used. According to the preferred mapping technique, first, the ratio of the two sensor loudnesses is used to calculate an inverse tangent angle. This angle was found to map very nicely to evenly-spaced sub sections of the fence perimeter. Shaking the fence at specific known locations can be used to create a simple table relating positions to the arctangent of the loudness ratio. A constant false alarm rate detector is used by comparing long time averaged rms background noise to short time averaged rms signals representing possible intrusions. The user can set the time average intervals, detection threshold, and even apply digital filtering to suppress unwanted environmental signals if needed. Detections can be used for automated switching of relays, dialing out via modem to play automated voice messages, or provide direct messaging via the Internet to pagers, hand-held PC's or desktop PCs in the form of HTML or automated XML documents. Of course, the present invention contemplates that alarms or alerts can take other forms as well.

This 2-channel embodiment is cost effective to use a standard Intel-class PC motherboard with integrated sound, video, and Ethernet. Software development tools from Microsoft or other companies allow a high performance common interface to be designed to run on a wide range of low cost hardware that is currently available world wide. The present invention, however, contemplates that any number of computers or embedded device can perform the same functions. This standard hardware also allows a number of 2-channel sensor fence PC's to work together as a network on a large perimeter fence where each PC has a designated section. If the PC's section does not have sharp turns with pulleys the time delay estimation technique may provide the most convenient localization. However, the sensors at either end of the tensioned wire would require long connecting cables to transmit the electrical vibration signals back to the PC. In such instances where long cables are used, preferably, low impedance sensors such as geophones are used to minimize any potential reliability and/or cost issues.

Figure 9:
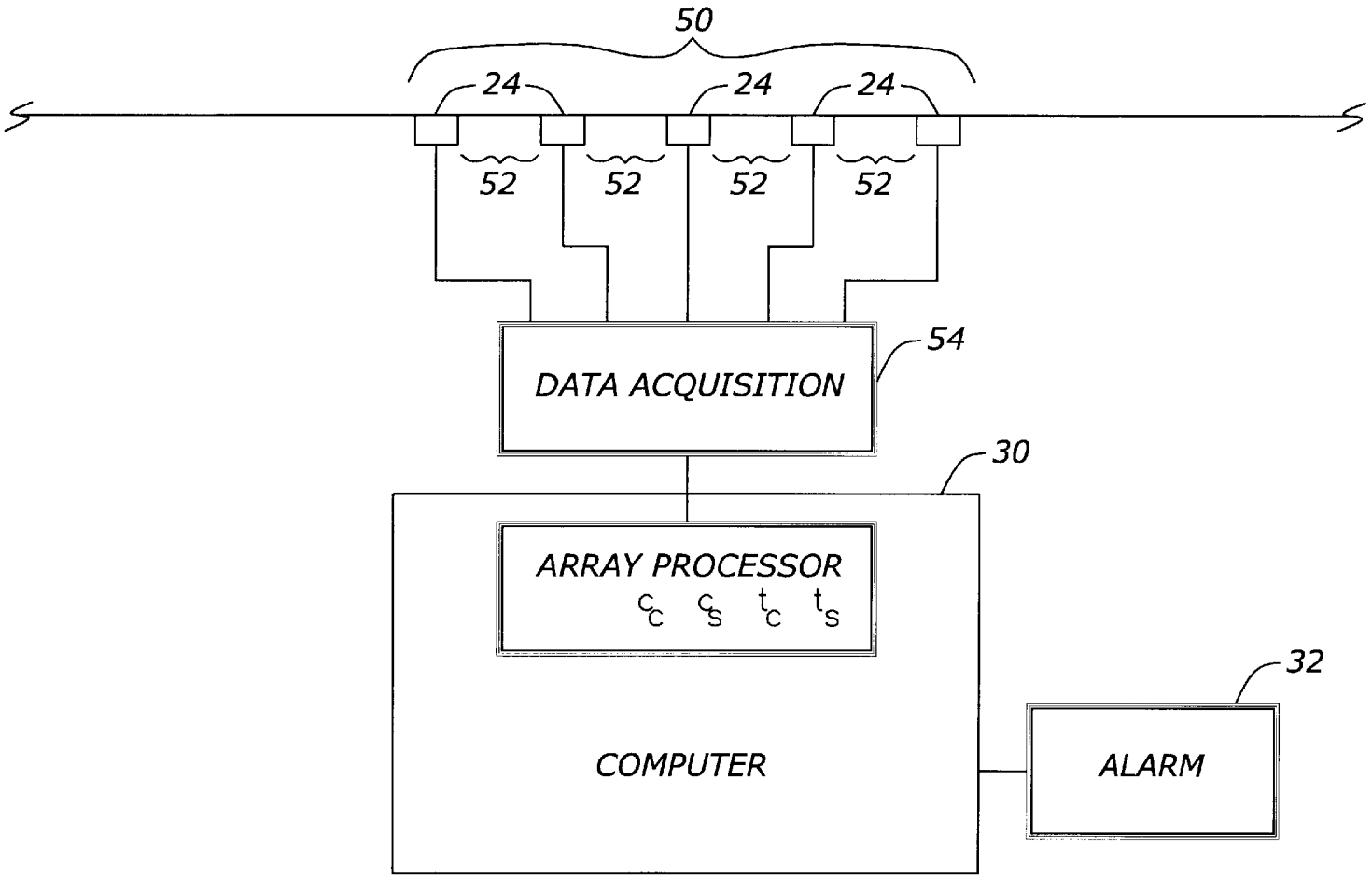
FIG. 9 is a block diagram showing another embodiment of the present invention using a sensor array.

Large perimeters such as airports and government facilities require a more advanced sensor fence system to achieve maximum reliability and detection and localization performance. This is achieved by using a precise multichannel array data acquisition system, such as an 8-channel 24-bit system with simultaneous channel sampling. FIG. 9 provides a diagram of this type of implementation of the present invention. In FIG. 9, a set 50 or array of sensors 24 are used, the sensors having a uniform aperture spacing 52 between them. Each of the sensors 24 is electrically connected to a data acquisition system 54 that is operatively connected to an array processor associated with a computer 30. An alarm 32 is also operatively connected to the computer. Although an array of five sensors is shown, the present invention contemplates that this array can be as small as two or greater than five. Increasing the number of sensors increases the number of characteristics of a wave that can be determined. For example, when there are two sensors, the control circuit can determine whether a wave is moving to the right or to the left. When there are three sensors in the array, the control circuit can determine right from left without crosstalk. When there are four sensors in the array, the control circuit can separate by wave direction as well as wave speed. With five or more sensors, the control circuit can separate wave direction as well as wave speed without crosstalk. When more than five sensors are used, additional characteristics such as noise level can be determined. Additional sensors can also be used to provide for redundancy in operation.

Five or more sensors are located with a known spacing array aperture at some site along the fence perimeter, perhaps near the middle of the tensioned wire section. For very large perimeters (10's of miles), it is practical to deploy tensioned wire sections to simplify installation and minimize disruption during maintenance. Also, simple detections provide a crude measure of localization. To localize within a section from a centrally located array of five or more sensors, one needs to recognize that both compressional waves and string waves will be excited in the tensioned wire. In steel, compressional waves travel over 5000 m/s while a typical string wave travels 10's of m/s for low tensions. These two very different wave speeds allow wave separation in the array of sensors using endfire array processing techniques.

According to one embodiment of the present invention, our array processor forms 4 "beamswith" outputs for fast (compressional $c=c_c$) and slow (string$c_s$) waves each from the left and from the right. It takes a minimum of 5 sensors to resolve these 2 unique waves. Using adaptive techniques such as minimum variance distortionless response (MVDR), one can precisely isolate the waves in one mode from the other three. MVDR allows one to construct a beam for a wave tat has zero response for the other three waves (no leakage effects). Separating left and right going waves allows localization in one half or the other half of the fence subsection. To precisely locate within a half subsection, the time difference of rival of the disturbance in the fast wave to the slow wave determines the distance to the source of the waves.

The time of arrival of the slow string wave $t_s$ minus the time of arrival of the fast compressional wave $t_c$ are used to calculate the distance from the array on the left or right side in equation (6).

$$d = \frac{(c_c c_s)(t_s - t_c)}{c_c - c_s} \tag{6}$$

When the two wave types arrive at nearly the same time, the source is close by. This is why the time difference of arrival is difficult to do for small perimeters, especially those with many corners with pulleys to reflect the waves. But for long straight sections of fence perimeter, equation (6) is the preferred technique for precise localization. The time differences can be estimated by direct cross correlation of the fast and slow beam outputs for a given direction, or comparing peaks in simply integrated rms signals from the beam outputs.

Using a PC-based platform allows detections and localizations to be automatically reported to a central PC console monitored by a security officer. In addition, information can be routed in the form of HTML pages, XML documents, etc., or simple messages for pagers or automated voice messages to a wide range of existing security automation systems. Even low-end PC's have plenty of processing power to handle the array processing requirements of this embodiment of the present invention. In addition, the present invention contemplates that the computer can be used in the control of deployment of appropriate nonlethal weapons to detain and/or dissuade intruders from further penetration, or for tagging intruders for later identification if desirable.

Whereas the invention has been shown and described in connection with the preferred embodiments thereof, it will be understood that many modifications, substitutions, and additions may be made which are within the intended broad scope of the following claims. For example, the present invention contemplates variations in the type of boundary used, for example, it can be a fence or can be located underground, the type of waveguide used, the number of sensors used, the type of sensors used, the control circuit used for processing, the type of processing performed, and other variations. These and other variations and their equivalents are within the spirit and scope of the invention.

What is claimed is:

1. A vibration detection and classification system, comprising:

a waveguide in operative contact with a boundary;

at least one sensor for sensing vibrations operatively connected to the waveguide, the waveguide extending the range the sensor;

a control circuit operatively connected to the at least one sensor and adapted for detecting and classifying vibration;

wherein the control circuit is adapted to perform at least one function selected from the set comprising resolving both compressional waves and string waves, separating waves by direction, separating waves by speed, processing a long term average vibration signal and a short-term average vibration signal and determining when the short-term average signal exceeds a threshold, and providing a constant false alarm rate detector.

2. The vibration detection and classification system of claim 1 wherein the control circuit is further adapted for detecting and classifying vibrations to determine if the boundary has been crossed by an intruder.

3. The vibration detection and classification system of claim 1 wherein the vibrations are acoustic waves.

4. The vibration detection and classification System of claim 1 further comprising at least one vibration coupler for coupling the waveguide to the boundary.

5. The vibration detection and classification system of claim 1 wherein the boundary includes a fence.

6. The vibration detection and classification system of claim 5 further comprising a vibration coupler operatively connected between the waveguide and the fence.

7. A vibration detection and classification system comprising:

a waveguide in operative contact with a boundary;

at least one sensor for sensing vibrations operatively connected to the waveguide;

the waveguide extending the range of the at least one sensor;

a control circuit operatively connected to the at least one sensor and adapted for detecting and classifying vibrations;

at least one thick arc-shaped band of metal for coupling the waveguide to the boundary.

8. The vibration detection and classification system of claim 1 wherein the waveguide is tensioned wire.

9. The vibration detection and classification system of claim 8 wherein the tension of the wire is between 50 to 200 pounds.

10. The vibration detection and classification system of claim 8 wherein the mass and tension of the wire are selected to match a natural frequency and wave speed of the boundary.

11. The vibration detection and classification system of claim 8 wherein tension is applied to the tensioned wire using at least one mass and at least one pulley.

12. The vibration detection and classification system of claim 11 wherein the control circuit is adapted for localization of one or more intrusions by using a loudness ratio.

13. The vibration detection and classification system of claim 1 wherein the waveguide is a pipe filled with a fluid and the vibrations are acoustic waves.

14. The vibration detection and classification system of claim 1 wherein the control circuit includes a transceiver, the transceiver adapted for transmitting a vibrational wave through the waveguide and receiving vibrational waves transmitted through the waveguide.

15. The vibration detection and classification system of claim 14 wherein the transceiver includes a clock.

16. The vibration detection and classification system of claim 15 wherein there are at least two transceivers, each transceiver having a clock, each of the clocks synchronized to a time base.

17. The vibration detection and classification system of claim 16 wherein the time base is derived from a GPS signal.

18. The vibration detection and classification system of claim 1 wherein the control circuit is adapted to determine when a sensed vibration signal exceeds a threshold.

19. The vibration detection and classification system of claim 18 wherein the threshold is partially based on an average background noise signal.

20. The vibration detection and classification system of claim 1 wherein the control circuit is adapted to process a long-term average vibration signal and a short-term avenge vibration signal and to determine when the short-term average vibration signal exceeds a threshold, at least partially based on the long-term average vibration signal.

21. The vibration detection and classification system of claim 1 further comprising an alarm circuit operatively connected to the control circuit.

22. The vibration detection and classification system of claim 1 wherein the control circuit is adapted to determine a location along the boundary associated with a sensed vibration.

23. The vibration detection and classification system of claim 22 wherein the control circuit is adapted to determine the location based on a time delay estimation.

24. The vibration detection and classification system of claim 22 wherein the control circuit is adapted to determine the location based on a loudness ratio.

25. The vibration detection and classification system of claim 24 wherein the loudness ratio is converted to an angle via an arctangent.

26. The vibration detection and classification system of claim 22 wherein the control circuit is adapted to determine the location based on a tithe delay estimation and a loudness ratio.

27. The vibration detection and classification system of claim 1 wherein at least two sensors are used td form an array and wherein the control circuit is adapted to determine one or more characteristics of a wave using the array.

28. The vibration detection and classification system of claim 27 wherein the one or more characteristics of the wave include a direction of the wave.

29. The vibration detection and classification system of claim 27 wherein the one or more characteristics of the wave include a speed of the wave.

30. The vibration detection and classification system of claim 27 wherein the array includes three or more sensors.

31. The vibration detection and classification system of claim 27 wherein the array includes at least five sensors and wherein the control circuit is adapted to resolve both compressional waves and string waves and directions associated with the compressional waves and string waves.

32. The vibration detection and classification system of claim 1 further comprising at least one vibration generator operatively connected to the wave guide.

33. The vibration detection and classification system of claim 32 wherein the vibration generator is operatively connected to the control circuit.

34. The vibration detection and classification system of claim 33 wherein the control circuit is adapted for automatic calibration.

35. A method of securing an area protected by a boundary, comprising:

mechanically transmitting a vibration from a portion of the boundary to a waveguide;

transmitting the vibration along the waveguide to a sensor;

sensing the vibration at the sensor; and determining at least one characteristic associated with the vibration, at least one of the at least one characteristic selected from a set comprising an average RMS signal over a time period, a time delay associated with the vibration and a loudness;

using the at least one characteristic associated with the vibration to determine if the vibration is indicative of an intrusion.

36. The method of claim 35 wherein the step of mechanically transmitting the vibration to the waveguide is mechanically transmitting the vibration through a vibration coupler connected between a fence defining the boundary and the waveguide.

37. The method of claim 36 wherein the waveguide is a tensioned wire.

38. The method of claim 35 wherein the at least one characteristic associated with die vibration includes a location associated with the vibration.

39. The method of claim 35 further comprising activating an alarm based on a detection of an intrusion.

40. The method of claim 35 farther comprising providing an alert based on a detection of an intrusion.

41. A method of monitoring a fence, comprising:

attaching a vibration couplet between a tensioned wire and the fence;

mechanically transmitting a vibration from a portion of the fence to the tensioned wire;

transmitting the vibration along the tensioned wire to a first sensor located remotely from the vibration coupler;

sensing the vibration at the first sensor; and determining if the vibration is indicative of a condition.

42. The method of claim 41 wherein the condition is art intrusion.

43. The method of claim 41 further comprising transmitting the vibration along the tensioned wire to a second sensor located remotely from the vibration coupler and sensing the vibration at the second sensor.

44. The method of claim 43 further comprising determining a first time sensing associated with the first sensor and a second time of sensing associated with the second sensor and determining a difference between the first time and the second time.

45. The method of claim 44 further comprising determining a location associated with a source of the vibration using the difference between the first time and the second time.

46. A method of securing an area protected by a boundary, comprising:

mechanically transmitting a vibration from a portion of the boundary to a waveguide;

transmitting the vibration along the waveguide to a sensor;

sensing the vibration with a plurality of sensors within an array; and determining at least one characteristic associated with the vibration selected from the set comprising an average RMS signal over a time period, a time delay associated with the vibration, and a loudness;

using the at least one characteristic associated with the vibration to determine if the vibration is indicative of an intrusion.

* * * * *

UNITED STATES PATENT AND TRADEMARK OFFICE

CERTIFICATE OF CORRECTION

PATENT NO. : 6,731,210 B2 
DATED : May 2, 2004
INVENTOR(S) : Swanson, David C., Nicholas C. Nicholas and David Rigsby It is certified that error appears in the above-identified patent and that said Letters Patent is hereby corrected as shown below:

Column 10,
Line 46, should read -- the range of the sensor --
Line 48, should read -- sensor and adapted for detecting and classifying vibrations --
Line 54, should read -- processing a long-term average vibration signal and a --
Line 65, should read -- 4. The vibration detection and classification system of --

Column 11,
Line 57, should read -- long-term average vibration signal and a short-term average --

Column 12,
Line 12, should read -- the location based on a time delay estimation and a loudness --
Line 15, should read -- claim 1 wherein at least two sensors are used to form an --
Line 64, should read -- characteristic associated with the vibration includes a location --

Column 13,
Line 4, should read -- attaching a vibration coupler between a tensioned wire --
Line 13, should read -- 42. The method of claim 41 wherein the condition is an --
Line 20, should read -- determining a first time of sensing associated with the first sensor and --

Signed and Sealed this

Thirteenth Day of July, 2004

JON W. DUDAS
*Acting Director of the United States Patent and Trademark Office*